US010662573B2

(12) United States Patent
Xu et al.

(10) Patent No.: US 10,662,573 B2
(45) Date of Patent: May 26, 2020

(54) VENTED HEAT PUMP DRYER

(71) Applicant: QINGDAO HAIER DRUM WASHING MACHINE CO., LTD., Shandong (CN)

(72) Inventors: Sheng Xu, Shandong (CN); Huacheng Song, Shandong (CN); Shujun Tian, Shandong (CN); Shiqiang Shan, Shandong (CN)

(73) Assignee: QINGDAO HAIER DRUM WASHING MACHINE CO., LTD., Qingdao, Shandong (CN)

( * ) Notice: Subject to any disclaimer, the term of this patent is extended or adjusted under 35 U.S.C. 154(b) by 132 days.

(21) Appl. No.: 15/753,477

(22) PCT Filed: Aug. 9, 2016

(86) PCT No.: PCT/CN2016/094140

§ 371 (c)(1),
(2) Date: Feb. 19, 2018

(87) PCT Pub. No.: WO2017/036280

PCT Pub. Date: Mar. 9, 2017

(65) Prior Publication Data

US 2018/0237980 A1 Aug. 23, 2018

(30) Foreign Application Priority Data

Aug. 31, 2015 (CN) ..... 2015 1 0548113

(51) Int. Cl.
*D06F 58/00* (2020.01)
*D06F 58/20* (2006.01)
(Continued)

(52) U.S. Cl.
CPC ..... *D06F 58/206* (2013.01); *D06F 58/10* (2013.01); *D06F 58/30* (2020.02); *D06F 58/02* (2013.01);
(Continued)

(58) Field of Classification Search
CPC ..... D06F 58/206; D06F 58/28; D06F 58/10; D06F 58/02; D06F 58/24; D06F 2058/2829; D06F 2058/2819
(Continued)

(56) References Cited

U.S. PATENT DOCUMENTS

2008/0216341 A1* 9/2008 Mukaiyama ..... D06F 58/206 34/124
2009/0293301 A1 12/2009 Koch et al.
(Continued)

FOREIGN PATENT DOCUMENTS

CN 101259362 A 9/2008
CN 101460672 A 6/2009
(Continued)

OTHER PUBLICATIONS

International Search Report (PCT/ISA/210) dated Oct. 26, 2016, by the Chinese Patent Office as the International Searching Authority for International Application No. PCT/CN2016/094140.
(Continued)

*Primary Examiner* — John P McCormack
(74) *Attorney, Agent, or Firm* — Buchanan Ingersoll & Rooney PC

(57) ABSTRACT

A vented heat pump dryer, comprising: an outer drum, an air-intake drying air duct and an air-exhaust drying air duct for allowing communicating the outer drum with outside respectively. The dryer is also provided with a heat pump system. A condenser of the heat pump system is arranged in the air-intake drying air duct, and an evaporator is arranged in the air-exhaust drying air duct. The air-exhaust drying air duct comprises at least two branches capable of being controlled to open and close. Each branch is provided with a corresponding evaporator. At different drying stage, the dryer makes exhaust air stream flow through different branches independently or at the same time, so that can adjust the working states of the heat pump reasonably and increase the drying efficiency of the dryer.

13 Claims, 5 Drawing Sheets

(51) Int. Cl.

| | |
|---|---|
| ***D06F 58/30*** | (2020.01) |
| ***D06F 58/10*** | (2006.01) |
| *D06F 58/38* | (2020.01) |
| *D06F 103/08* | (2020.01) |
| *D06F 58/02* | (2006.01) |
| *D06F 58/24* | (2006.01) |

(52) U.S. Cl.
CPC ..... *D06F 58/24* (2013.01); *D06F 58/38* (2020.02); *D06F 2103/08* (2020.02)

(58) Field of Classification Search
USPC ..... 34/108, 119
See application file for complete search history.

(56) References Cited

U.S. PATENT DOCUMENTS

| | | | | |
|---|---|---|---|---|
| 2012/0030960 | A1 | 2/2012 | Ryoo et al. | |
| 2012/0144693 | A1* | 6/2012 | Wakizaka ..... | D06F 58/206 34/492 |
| 2014/0366397 | A1 | 12/2014 | Wakizaka et al. | |

FOREIGN PATENT DOCUMENTS

| | | | |
|---|---|---|---|
| CN | 201364007 | Y | 12/2009 |
| CN | 102587074 | A | 7/2012 |
| CN | 104420145 | A | 3/2015 |
| CN | 104532522 | A | 4/2015 |
| EP | 1983094 | A1 | 10/2008 |
| JP | 2008029654 | A | 2/2008 |
| JP | 2008086424 | A | 4/2008 |
| JP | 2008173330 | A | 7/2008 |
| JP | 2008220814 | A | 9/2008 |
| JP | 2010075588 | A | 4/2010 |
| JP | 2015024116 | A | 2/2015 |
| KR | 20110082240 | A | 7/2011 |
| KR | 20120086153 | A | 8/2012 |
| KR | 20140147026 | A | 12/2014 |

OTHER PUBLICATIONS

Written Opinion (PCT/ISA/237) dated Oct. 26, 2016, by the Chinese Patent Office as the International Searching Authority for International Application No. PCT/CN2016/094140.

The Notice of Preliminary Rejection dated Aug. 12, 2019 in corresponding Korean Patent Application No. 10-2018-7007659 with English Translation, 9 pages.

Extended European Search Report dated Jul. 30, 2018 in corresponding European Patent Application No. 16840709.6-1018, 7 pages.

Notification of Reasons for Refusal dated Sep. 10, 2019 in corresponding Japanese Patent Application No. 2018-511116 with English Translation, 2 pages.

Chinese Search Report dated Apr. 8, 2019 in corresponding Chinese Patent Application No. 201510548113X, 2 pages.

* cited by examiner

VENTED HEAT PUMP DRYER

TECHNICAL FIELD

The present disclosure relates to a clothes drying apparatus in the field of the household appliances, in particular, relates to a vented heat pump dryer.

BACKGROUND

The existing dryer mainly comprises two following ways:

The first one is an air vented dryer, its working principle is as follows: the dryer draws air from the surrounding area, heats the air by using the heating wire, then the heated high-temperature dry air is blown into the outer drum, and the moisture of the clothes therein is vaporized. The vaporized moisture is mixed into the air and the air becomes hot moist air. The hot moist air is exhausted from the outer drum eventually to realizing the purposes of drying the clothes. However, since the exhaust air contains a large amount of waste heat in the above manner, it cannot be recycled, resulting in large energy consumption and low efficiency.

The second one is a heat pump dryer, its working principles is as follows: the outer drum is connected with both end of the drying air duct to form an circulating air pathway. The air stream in the drying air duct is heated by the condenser of the heat pump system and becomes hot dry air, and then is introduced into the outer drum. The hot dry air introduced into the outer drum gasifies the moisture of the clothes therein. The gasified moisture is mixed into the air and the air becomes hot moist air, and then the hot moist air is exhausted from the outer drum and introduced into the drying air duct. The moisture is condensed from the hot moist air introduced into the drying air duct by the evaporator, and then the hot moist air becomes the low-temperature dry air. Then the low-temperature dry air flows through the evaporator again to complete the circulation of air stream. Through the continuous operation of the dryer to generate the above circulating air flow, the purpose of drying the clothes is eventually achieved.

Although the heat pump dryer can recycle the waste heat of the air exhausted from the outer drum and reduce the energy consumption, the dehumidification speed is slower than that of the vented dryer since the moisture is completely condensed by the evaporator because the air within it is always in a closed circulation state. Therefore, how to combine the heat pump dryer and the vented dryer to obtain a vented heat pump dryer has become a issue that needs to be addressed urgently. The vented heat pump dryer can recycle the exhaust air, has a lower energy consumption and higher drying efficiency, and higher clothes cleanliness after drying.

In view of this, the present disclosure is proposed.

SUMMARY

An object of the present disclosure is to provide a vented heat pump dryer, so as to achieve the effect that the vented dryer utilizes the heat pump system to recycle the exhaust air stream and preheat the intake air stream, and achieve the purposes of improving the drying efficiency and reducing energy consumption.

Another object of the present disclosure is to provide a vented heat pump dryer, the vented heat pump dryer has different heat pump load at different drying stage to improves the drying efficiency.

In order to realize the objective of the invention, technical solutions as follows are adopted.

A vented heat pump dryer, comprising: an outer drum, and an air-intake drying air duct and an air-exhaust drying air duct for allowing communicating the outer drum with outside respectively. The dryer is also provided with a heat pump system, a condenser of the heat pump system is arranged in the air-intake drying air duct, and an evaporator is arranged in the air-exhaust drying air duct.

Further, the air-exhaust drying air duct comprises at least two branches capable of being controlled to open and close, and each branch is provided with a corresponding evaporator. That makes an exhaust air stream flow through the corresponding branch at different drying stage to adjust the power of the heat pump system.

Further, each of two branches is provided with an evaporator, and two evaporators are provided with heat exchanger fins with different arrangement densities. Two evaporators are connected to the same heat pump system by a three-way control valve in side-by-side manner. A refrigerant in the heat pump system flows through two evaporators at the same time or independently.

Further, the evaporator of the heat pump system comprises a first part and a second part having different arrangement densities of the heat exchanger fins. The first part and the second part are respectively arranged in different branches of the air-exhaust drying air duct.

Further, two branches are correspondingly connected in parallel, and an air door (17) is arranged in an end of the two branches near the air outlet end of the outer drum for controlling the two branches to open and close.

Further, the two branches are respectively provided with different numbers of evaporators, and all evaporators are connected to the same heat pump system in side-by-side manner. The refrigerant in the heat pump system flows through each of evaporators in the two branches at the same time or independently.

Preferably, the density of the heat exchanger fins in each evaporator is the same. And the heat exchanger fins of each evaporator in the same branch are in a staggered arrangement, so that the arrangement densities of the fins in two branches are different.

Further, a middle of the air-exhaust drying air duct is provided with a partition plate. The partition plate divides a portion of the air-exhaust drying air duct corresponding to the partition plate into a first branch and a second branch in parallel; and an air door is arranged in an end of the partition plate near an air outlet end of the outer drum for controlling the two branches to open independently or simultaneously.

Preferably, the air door is arranged in an end of the partition plate near the outer drum, the air door is connected with the partition plate through a hinge to make the air door rotate around the hinge for opening the first branch and the second branch independently or at the same time.

Further, at a later stage of a drying process or in drying at higher drying temperature, the air door is in a first state, the first branch is opening and the second branch is closed, the exhaust air stream only flows through the evaporator with the heat exchanger fins of smaller density in the first branch.

At an earlier 1 stage of the drying process or in drying at lower drying temperature, the air door is in a second state for closing the first branch and opening the second branch, the exhaust air stream only flows through the evaporator with the heat exchanger fins of larger arrangement density in the second branch.

Further, when the dryer is in a special working condition in which clothes are dried quickly, the air door is in a third state, and the first branch and the second branch are opening, and the exhaust air stream is respectively discharged through the evaporators of the two branches at the same time to increase the upper limit of the endothermic saturation; Meanwhile, in order to match the endothermic saturation of the refrigerant, the flow rate of the drying air stream is increased and the clothing drying time is shortened.

Further, a compressor of the heat pump system is arranged in the air-intake drying air duct located upstream from the condenser for preheating the intake air stream.

Further, the air-intake drying air duct is also provided with an auxiliary heating wire, and the auxiliary heating wire is located downstream from the condenser; the air-exhaust drying air duct is provided with a fan for controlling the flow direction of the air stream, and the fan is arranged upstream from the air door. A filter net is arranged in the air-exhaust drying air duct between the fan and the air outlet of the outer drum to filter the threads of the exhaust air stream.

Further, the air-exhaust drying air duct comprises at least three branches, each branch is provided with correspondingly air door for opening and closing the branch. Each branch is respectively provided with a corresponding evaporator.

By adopting the above technical solutions, the present disclosure has the following advantages compared with the prior art.

By the above arrangements and methods, when the dryer is at earlier drying stage having lower-temperature, the air door is in the second state. So that the exhaust air stream flows through the whole evaporator or most of the exhaust air stream flows through the part having more intensive fins to increase the heat absorption effect of the evaporator, the heat absorption load of the refrigerant medium and the load of the heat pump system to improve heating temperature of the intake air stream after flowing through the condenser. Meanwhile, when the dryer is at the later drying stage having higher temperature, the air door is in the first state. So that all or most of the air flows through the part having more sparse fins of the evaporator to reduce the amount of the heat absorption of the evaporator. And it keeps the condensation temperature of the heat pump system to close or slightly lower than 70° C. to achieve the purpose of saving energy.

By the means of this ways, at the later stage of the drying process of the dryer, it can prevents to execute the steps of closing the auxiliary heating wire or closing the compressor in order to reduce the heat pump load. The heat input at the later drying stage of the dryer is increased, and the improvements of the drying rates of the dryer in different periods are properly allocated.

Meanwhile, it can avoid the accumulation of the threads on the surface of the fins of the evaporator. Because the temperature of the exhaust air stream is higher at the later drying stage of the drying process, and the interior of the outer drum is relatively dry, the clothes wear out easily, and threads formed threads by the abrasion will be discharged by the exhaust air stream. Although most of the threads can be filtered by the filter net, a fraction of extremely small threads will pass through the filter to reach the evaporator. If the air door is under control to enable the exhaust air stream to flow though the part having smaller density heat exchanger fins of the evaporator at the later stage, the threads would be much easier to pass through the evaporator without being intercepted and accumulated.

The structure of the present disclosure is simple, and the effect is remarkable. It is suitable for promotion.

Description of main components: 1—outer drum 2—air-intake drying air duct 3—air-exhaust drying air duct 4—condenser 5—evaporator 6—auxiliary heating wire 7—filter net 8—fan 9—compressor 10—throttling device 11—first branch 12—second branch 13—first part 14—second part 15—first evaporator 16—second evaporator 17—partition plate 18—hinge 19—air door 20—air inlet end 21—air outlet end 22—air inlet 23—air outlet 25—three-way control valve 26—first air door 27—second air door 28—third branch 29—third part

DETAILED DESCRIPTION

The following is further and specific description of the present disclosure with accompanying embodiments.

Figure 1:
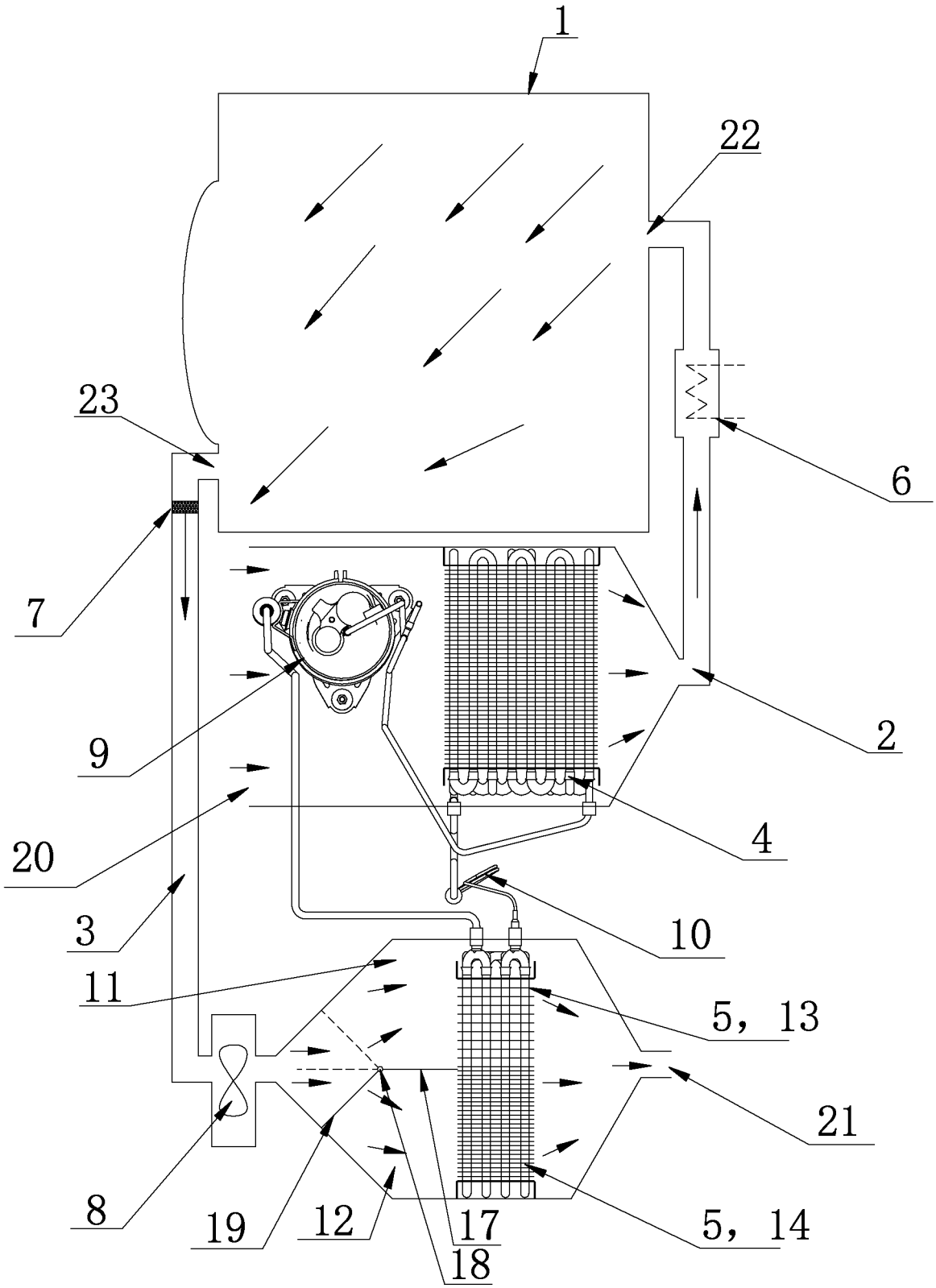
FIG. 1 is a structure schematic diagram of a dryer in an embodiment of the present disclosure.

As shown in FIG. 1, a vented heat pump dryer provided in the embodiment of the present disclosure, comprises an outer drum 1, an air-intake drying air duct 2, and an air-exhaust drying air duct 3. One end of the air-intake drying air duct 2 is communicated with air inlet 22 of the outer drum, another end is an air inlet end 20 which is communicated with the atmosphere. One end of the air-exhaust drying air duct 3 is communicated with the air outlet 23 of the outer drum, another end is an air inlet end 21 which is communicated with the atmosphere. The dryer is also provided with a heat pump system. The heat pump system at least comprises a condenser 4, a throttling device 10, an evaporator 5 and a compressor 9, which are sequentially connected end to end via a pipeline to from a flow channel for circulating the refrigerant.

In the embodiment of the present disclosure, a condenser 4 is arranged in the air-intake drying air duct 2, and an evaporator 5 is arranged in the air-exhaust drying air duct 3. An outlet end of the compressor 9 is an end for allowing the refrigerant to flow out from the compressor, and the outlet end is connected with the condenser 4 through the pipeline. An inlet end of the compressor 9 is the end for allowing the refrigerant to flow into the compressor, and the inlet end is connected with the evaporator 5 through the pipeline. Thus, under the action of the compressor, the refrigerant medium in the heat pump system circulates in the direction from outlet end of the compressor to the condenser, the throttling device, the evaporator, and to the inlet end of the compressor. It achieves the purposes of heating the intake air stream which flows through the condenser, and cooling the exhaust air stream which flows through the evaporator, and then achieves the purpose of drying the clothes in the outer drum.

In the embodiment of the present disclosure, in order to improve the working efficiency of the heat pump system, the compressor 9 is arranged in the air-intake drying air duct 2 located upstream from the condenser 4 to preheat the intake air stream by using the heat radiation during the operation of the compressor. In order to improve the heating rate of the intake air stream and the temperature of the intake air stream flowing into the outer drum, it is preferable that the air-intake drying air duct 2 is provided with an auxiliary heating wire 6 for electrically heating the air stream passing through. Further preferably, the auxiliary heating wire 6 is arranged in the air-exhaust drying air duct 2 located downstream from the condenser 4 to improve the electric heating efficiency.

In the embodiment of the present disclosure, the air-intake drying air duct and/or the air-exhaust drying air duct is provided with a fan 8 for controlling the air stream direction in the air passage. Preferably, the fan 8 is only arranged in the air-exhaust drying air duct 3 and located upstream from the evaporator 5. So that the air stream in the air-intake drying air duct 2 flows from the air inlet end 20 to the air inlet 22, and the air stream in the outer drum 1 flows from the air inlet 22 to the air outlet 23, and the air stream in the air-exhaust drying air duct 3 flows from the air outlet 23 to the air outlet end 21.

In the embodiment of the present disclosure, the air-exhaust drying air duct 3 is provided with a filter net 7 for filtering the threads in the exhaust air stream. The filter net 7 is arranged in the air-exhaust drying air duct 3 and located upstream from the fan 8 and close to the air outlet 23.

However, the vented heat pump dryer adopting the above methods exists the following problems: at the later drying stage of the drying process of the dryer or in drying at high-temperature, the temperature and the humidity of the exhaust air are gradually increased. When the upper limit of the load of the heat pump system is reached, it needs to decrease the input power of the heating wire or make the heating wire intermittently work for preventing the load of the heat pump from exceeding the limit. But, this is equivalent to limit the input of the heating energy. From the evaluation of the drying time, it is not conductive for clothes drying.

As shown in from FIG. 1 to FIG. 6, in the embodiment of the present disclosure, the air-exhaust drying air duct 3 at least comprises two branches, each branch is provided with correspondingly air door 19 for opening and closing the branch, and each branch is respectively provided with a corresponding evaporator 5. The arrangement densities of the heat exchanger fins set on the evaporator 5 in each branch are different, and the exhaust air flow during different working period of the dryer is discharged through corresponding branch independently or at the same time, and the heat absorption rate of the evaporator is under control. This avoids the need to reduce the heat input of the auxiliary heating wire at the later drying stage of dryer or high-temperature drying so as to shorten the drying time of the dryer. At the same time, it can minimize the exhaust resistance, and improve the drying efficiency of the dryer.

Embodiment 1

As shown in FIG. 1, in the present embodiment, a partition plate 17 is arranged in the air-exhaust drying air duct 3 between the fan 8 and the air outlet end 21. The partition plate 17 extends in the direction parallel to the axial of the air-exhaust drying air duct 3. So that the corresponding part of the air-exhaust air duct 3 is divided into two branches in parallel, namely a first branch 11 and a second branch 12.

In the present embodiment, the evaporators 5 of the heat pump system are correspondingly arranged in the first branch 11 and the second branch 12. The evaporator 5 extends in the direction perpendicular to the axis of the air-exhaust drying air duct 3, and crosses the partition plate 17. So that the first part 13 of the evaporator 5 is located in the first branch 11, and the second part 14 is located in the second branch 12. The evaporator is provided with a plurality of heat exchanger fins extending in the direction parallel to the axial of the air-exhaust drying air duct and distributing at intervals. Preferably, the interval distance of the heat exchanger fins of the first part 13 is larger than the interval distance of the heat exchanger fins of the second part 14. It enables that the heat exchanger fins of the first part 13 and the second part 14 are distributed with different arrangement densities, which can be suitable for the different working periods of the dryer.

In the present embodiment, the ends of the two branches near the air outlet 23 of the outer drum are provided with the air doors 19 for controlling the opening and closing of the branches. Preferably, one end of the air door 19 is connected with the end of the partition plate 17 near the air inlet end through a hinge 18. The air door 19 can rotate around the hinge 18 to respectively and correspondingly open or close the first branch 11 and the second branch 12.

Figure 2:
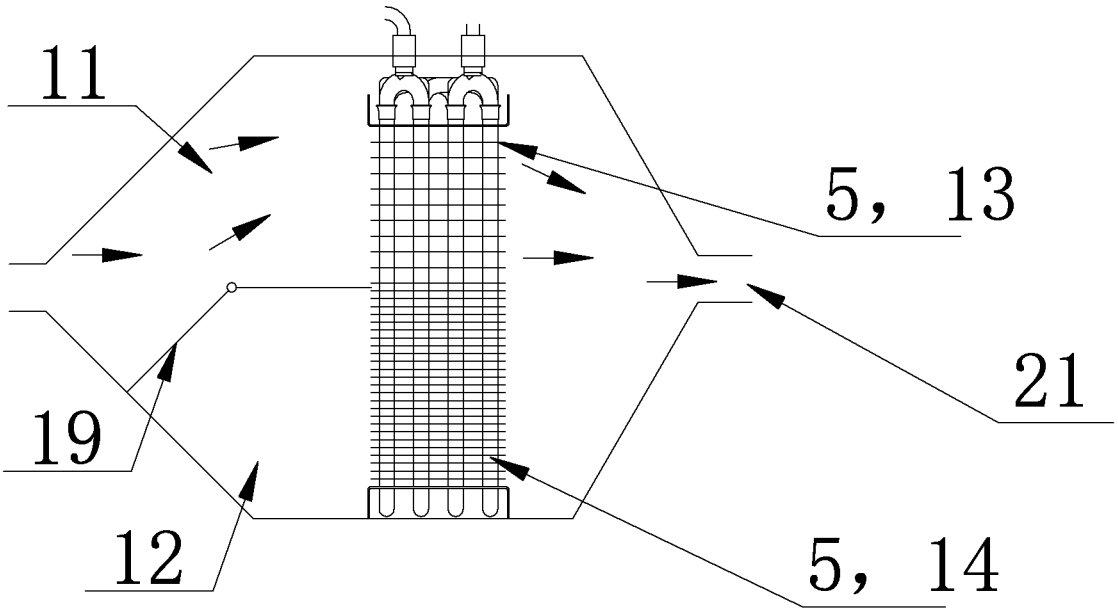
FIG. 2 is a structure schematic diagram of a corresponding air-exhaust drying air duct with air door in the first state in an embodiment of the present disclosure.

In the present embodiment, the air door 19 has the following states:

As shown in FIG. 2, the air door 19 is in the first state for opening the first branch 11 and closing the second branch 12. At the moment, the exhaust air stream is discharged through the first branch 11, and exchanges heat with the first part 13 having heat exchanger fins of smaller density on the evaporator. It is suitable for the later stage of the drying process of the dryer or drying the clothes at the relatively higher drying temperature.

Figure 3:
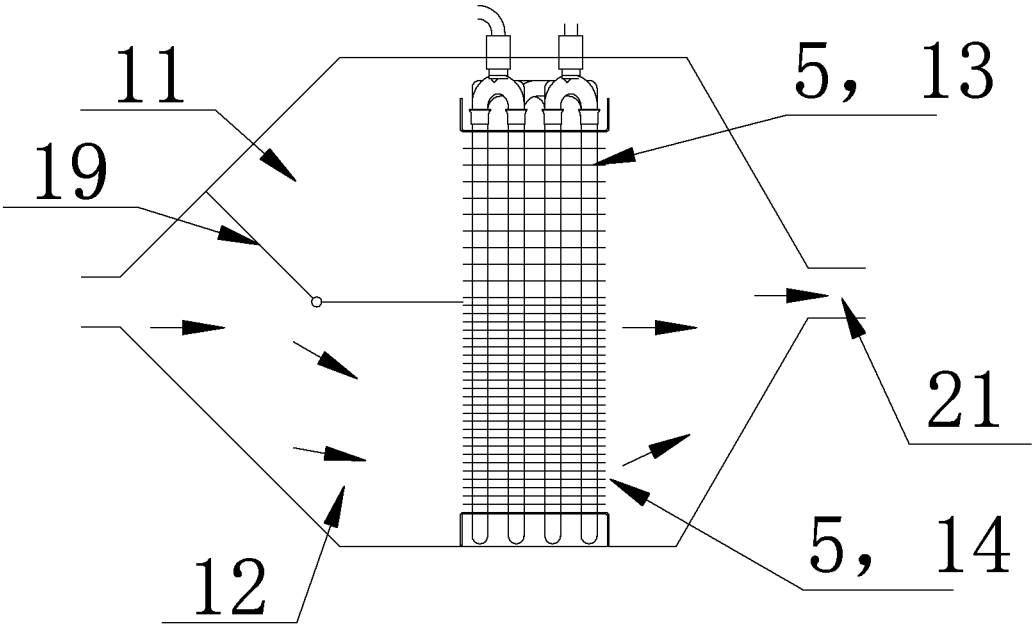
FIG. 3 is a structure schematic diagram of a corresponding air-exhaust drying air duct with air door in the second state in an embodiment of the present disclosure.

As shown in FIG. 3, the air door 19 is in the second state for closing the first branch 11 and opening the second branch 12. At the moment, the exhaust air stream is discharged through the second branch 12, and exchanges heat with the second part 14 having heat exchanger fins of larger arrangement density on the evaporator. It is suitable for the earlier stage of the drying process of the dryer or drying the clothes at relatively lower temperature.

Figure 4:
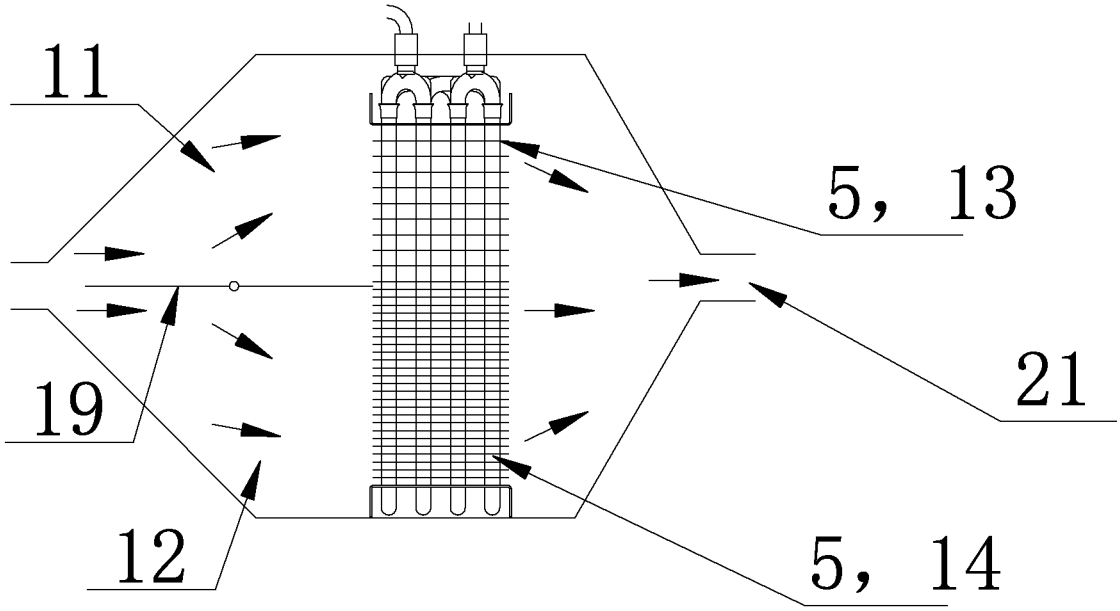
FIG. 4 is a structure schematic diagram of a corresponding air-exhaust drying air duct with air door in the third state in an embodiment of the present disclosure.

Preferably, as shown in FIG. 4, the door air also has a third stage for opening the first branch 11 and opening the second branch 12. At the moment, the exhaust air stream is discharged through the first and the second branch at the same time, and exchanges heat with the first and the second part of the evaporator. It enables that the exhaust air stream is respectively discharged through the evaporator of two branches at the same time, and the upper limit of the endothermic saturation is increased. Meanwhile, in order to match the endothermic saturation of the refrigerant, the flow rate of the drying air stream is increased and the clothing drying time is shortened. It is suitable for the dryer carrying out special conditions for drying the clothes quickly.

By the above arrangements and methods, when the dryer is at the lower-temperature earlier drying stage, the air door is in the second state. It enables that exhaust air stream flows through the whole evaporator or most of the exhaust air stream flows through the part of which the fins are more intensive for increasing the heat absorption effect of the evaporator, the heat absorption load of the refrigerant medium and the load of the heat pump system to improve heating temperature of the intake air stream after flowing through the condenser. Meanwhile, when the dryer is at the higher temperature later drying stage, the air door is in the first state. It enables that all or most of air flows through the part having more sparse fins on evaporator to reduce the amount of the heat absorption of the evaporator. And it keeps the condensation temperature of the heat pump system to close or slightly lower than 70° C. to achieve the purpose of saving energy.

By the means of this ways, at the later stage of the drying process of the dryer, it can prevents to execute the steps of closing the auxiliary heating wire or closing the compressor in order to reduce the heat pump load. The heat input at the later drying stage of the dryer is increased, and the improvements of the drying rates of the dryer in different periods are properly allocated.

Meanwhile, the air door is in the third state, when the dryer needs to dry clothes quickly. It enables that the exhaust air stream is simultaneously discharged through the first branch and the second branch which are in parallel to improve the heat absorption rate of the evaporator. The temperature of intake air stream flowing through the condenser is increased to achieve the purpose of reducing the drying time.

Embodiment 2

Figure 5:
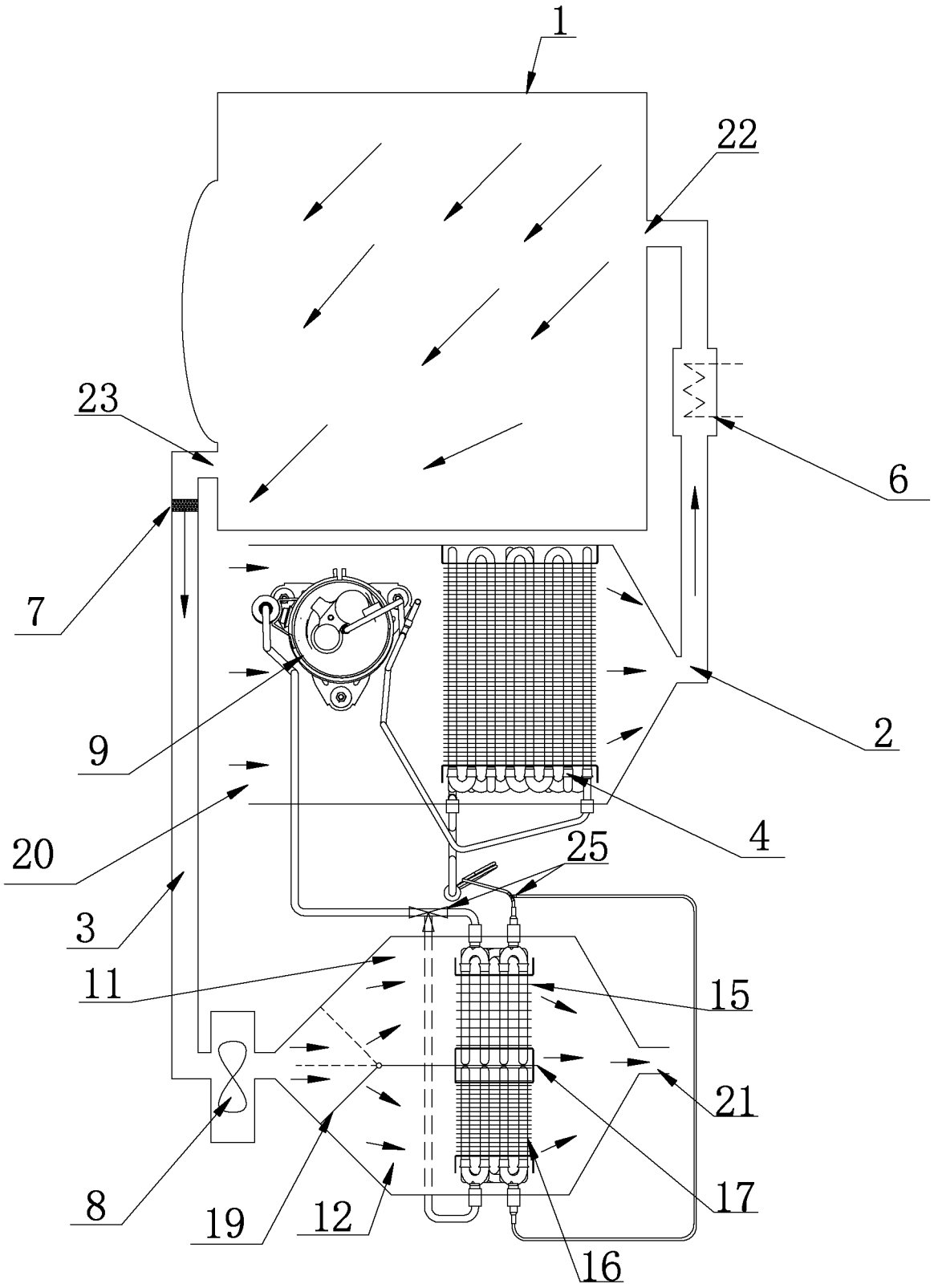
FIG. 5 is a structure schematic diagram of a dryer in another embodiment of the present disclosure.

As shown in FIG. 5, the differences between the present embodiment and the above embodiment 1 are as follows: a first evaporator 15 is arranged in the first branch 11 of the air-exhaust drying air duct 3, a second evaporator 16 is arranged in the second branch 12. The arrangement density of the heat exchanger fins of the first evaporator 15 is less than that of the heat exchanger fins of the second evaporator 16.

In the present embodiment, the air inlet ends of the first evaporator 15 and the second evaporator 16 are communicated with the throttling device 10 by a three-way control valve 25. The air outlet ends of the first evaporator 15 and the second evaporator 16 are communicated with the compressor 9 by another three-way control valve 25. Thereby, it enables the refrigerant medium to flow through the first evaporator 15 and the second evaporator 16 independently or at the same time to realize the control of the flow of the refrigerant.

The corresponding states of the three-way control valve 25 and the air door 19 are as follows:

When the air door 19 is in the first state, the refrigerant medium in the three-way control valve 25 flows into the first evaporator 15 without flowing into the second evaporator 16.

When the air door 19 is in the second state, the refrigerant medium in the three-way control valve 25 flows into the second evaporator 16 without flowing into the first evaporator 15.

When the air door 19 is in the third state, the refrigerant medium in the three-way control valve 25 flows into the first evaporator 15 and the second evaporator 16 at the same time.

The flow path of the refrigerant is under control by setting separate evaporator in each of the two branches respectively. It can avoid the refrigerant to flow into the evaporator which is not provided in the exhaust air stream branch, in order to reduce the energy consumption of the heat pump system and increase the heat exchange efficiency of the refrigerant. Meanwhile, it is convenient for the maintenance of the evaporator in different branches, and the later maintenance cost of the dryer is improved.

Embodiment 3

The differences between the present embodiment and the above embodiment 2 are as follows: the first branch is provided with an evaporator, while the second branch is provided with at least two evaporators. It enables that the arrangement density of the heat exchanger fins of the evaporator in the first branch is less than that of the heat exchanger fins of the evaporator in the second branch (not shown in the drawings).

Embodiment 4

Figure 6:
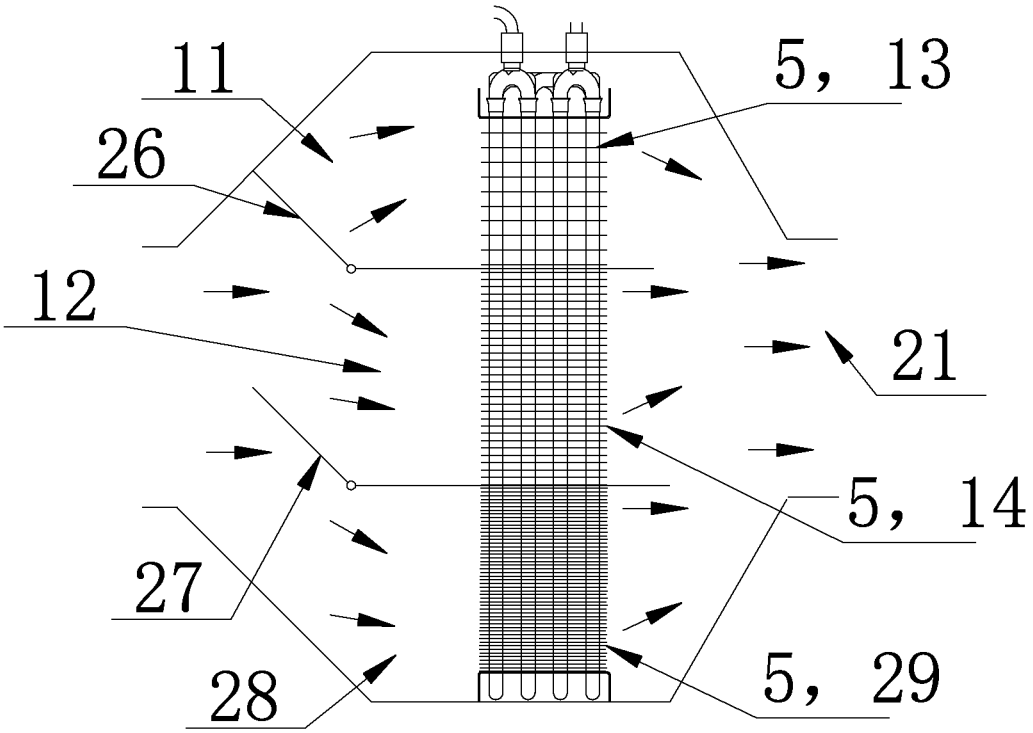
FIG. 6 is a structure schematic diagram of a dryer in another embodiment of the present disclosure.

As shown in FIG. 6, the differences between the present embodiment and the above embodiment 1 to 3 are as follows: the air-exhaust drying air duct 3 comprises at least three branches, each branch is provided with correspondingly air door for opening and closing the branch. Each branch is respectively provided with a corresponding evaporator 5.

By the above settings, the rationality of the evaporator arrangement can be further improved. It provides more power options for the dryer to further match the corresponding heat pump power in different periods. The purposes of improving the drying efficiency and reducing energy consumption can be realized.

As shown in FIG. 6, in the present embodiment, two parallel partition plates 17 are arranged in the air-exhaust drying air duct 3 between the fan 8 and the air outlet end 21. The partition plates 17 both extend in the direction parallel to the axis of air-exhaust drying air duct 3, so that the corresponding part of the air-exhaust drying air duct 3 is divided into three branches in parallel, namely the first branch 11, the second branch 12 and the third branch 28.

In the present embodiment, the evaporator 5 of the heat pump system extends in the direction perpendicular to the axis of the air-exhaust drying air duct 3, and passes through successively the two partition plate 17. It enables that the first part 13 of the evaporator 5 is located in the first branch 11, the second part 14 of the evaporator 5 is located in the second branch 12, and the third part 29 is located in the third branch 28.

Preferably, the interval distance of the heat exchanger fins of the first part 13 is larger than the interval distance of the heat exchanger fins of the second part 14, and the interval distance of the heat exchanger fins of the second part 14 is larger than the interval distance of the heat exchanger fins of the third part 29. It enables that the heat exchanger fins of the first part 13, the second part 14 and the third part 29 are distributed with different arrangement densities. So that can be suitable for the different working periods of the dryer.

In the present embodiment, a first air door 26 is arranged at the partition plate between the first branch 11 and the second branch 12. A second air door 27 is arranged at the partition plate between the second branch 12 and the third branch 13.

The first air door 26 has the three following state: the first state, in which the first branch is opened and the second branch is closed; the second state, in which the first branch is closed and the second branch is opened; the third state, in which the first branch is opened and the second branch is opened.

The second air door 27 has the three following state: the first state, in which the second branch is opened and the third branch is closed; the second state, in which the second branch is closed and the third branch is opened; the third state, in which the second branch is opened and the third branch is opened.

By the cooperation of the first air door and the second air door, it enables that the first branch, the second branch and the third branch can be opened independently or at the same time. It can realize the rational allocation of the exhaust air stream, and achieve the purpose of improving the working efficiency of the dryer and reducing the energy consumption.

The implementation solutions of the foregoing embodiments can be further combined or replaced. The embodiments are merely the description of the preferred embodiments of the present invention, but are not intended to limiting the conception and scope of the present invention. Without departing from the scope of the technical solution of the present invention, any changes and modifications made according to the technical essence of the present invention by any persons skilled in the present invention shall all be covered within the scope of the technical solution of the present invention.

The invention claimed is:

1. A vented heat pump dryer, comprising:

an outer drum;

an air-intake drying air duct and an air-exhaust drying air duct, each of the air-intake drying air duct and the air-exhaust drying air duct allowing the outer drum communicating to communicate with an outside;

a heat pump system including a condenser arranged in the air-intake drying air duct, and an evaporator arranged in the air-exhaust drying air duct, wherein the air-exhaust drying air duct includes at least two branches configured to be controlled to open and close, each branch is provided with the evaporator.

2. The vented heat pump dryer according to claim 1, wherein each of two branches is provided with an evaporator, the two evaporators are provided with heat exchanger fins with different arrangement densities, the two evaporators are connected to a same heat pump system by a three-way control valve in side-by-side manner, and a refrigerant in the heat pump system flows through the two evaporators at the same time or independently.

3. The vented heat pump dryer according to claim 1, wherein the evaporator of the heat pump system comprises a first part and a second part, the first part and the second part having different arrangement densities of heat exchanger fins, and the first part and the second part are respectively arranged in different branches of the air-exhaust drying air duct.

4. The vented heat pump dryer according to claim 1, wherein the two branches are respectively provided with different numbers of evaporators, all evaporators are connected to the same heat pump system in a side-by-side manner, and a refrigerant in the heat pump system flows through each of the evaporators in the two branches at the same time or independently.

5. The vented heat pump dryer according to claim 1, wherein a middle of the air-exhaust drying air duct is provided with a partition plate, the partition plate divides a portion of the air-exhaust drying air duct corresponding to the partition plate into a first branch and a second branch in parallel, and an air door is arranged in an end of the partition plate near an air outlet end of the outer drum for controlling the two branches to open independently or simultaneously.

6. The vented heat pump dryer according to claim 5, wherein at a later stage of a drying process or in drying at higher drying temperature, the air door is in a first state, the first branch is open and the second branch is closed, and an exhaust air stream only flows through the evaporator with heat exchanger fins of smaller arrangement density in the first branch.

7. The vented heat pump dryer according to claim 5, wherein at an earlier stage of the drying process or in drying at lower drying temperature, the air door is in a second state for closing the first branch and opening the second branch, and the exhaust air stream only flows through the evaporator with heat exchanger fins of larger arrangement density in the second branch.

8. The vented heat pump dryer according to claim 5, wherein when the dryer is in a special working condition in which clothes are dried quickly, the air door is under control to open the first branch and the second branch.

9. The vented heat pump dryer according to claim 1, wherein: a compressor of the heat pump system is arranged in the air-intake drying air duct located upstream from the condenser for preheating an intake air stream.

10. The vented heat pump dryer according to claim 1, wherein the air-intake drying air duct is further provided with an auxiliary heating wire, the auxiliary heating wire is located downstream from the condenser, and the air-exhaust drying air duct is provided with a fan for controlling the flow direction of an air stream, the fan is arranged upstream from the air door.

11. The vented heat pump dryer according to claim 2, wherein a middle of the air-exhaust drying air duct is provided with a partition plate, the partition plate divides a portion of the air-exhaust drying air duct corresponding to the partition plate into a first branch and a second branch in parallel, and an air door is arranged in an end of the partition plate near an air outlet end of the outer drum for controlling the two branches to open independently or simultaneously.

12. The vented heat pump dryer according to claim 3, wherein a middle of the air-exhaust drying air duct is provided with a partition plate, the partition plate divides a portion of the air-exhaust drying air duct corresponding to the partition plate into a first branch and a second branch in parallel, and an air door is arranged in an end of the partition plate near an air outlet end of the outer drum for controlling the two branches to open independently or simultaneously.

13. The vented heat pump dryer according to claim 4, wherein a middle of the air-exhaust drying air duct is provided with a partition plate, the partition plate divides a portion of the air-exhaust drying air duct corresponding to the partition plate into a first branch and a second branch in parallel, and an air door is arranged in an end of the partition plate near an air outlet end of the outer drum for controlling the two branches to open independently or simultaneously.

* * * * *